United States Patent [19]

Hutchison

[11] 4,212,138

[45] Jul. 15, 1980

[54] PORTABLE CONFINED SURFACE SAND BLAST APPARATUS

[76] Inventor: Gary Hutchison, 1355 Day Rd, Hudson, Mich. 49247

[21] Appl. No.: 939,245

[22] Filed: Sep. 5, 1978

[51] Int. Cl.[2] ..... B24C 3/06

[52] U.S. Cl. ..... 51/427; 15/344; 15/405

[58] Field of Search ..... 51/410, 427, 429; 15/344, 345, 347, 405, 407, 408

[56] References Cited

U.S. PATENT DOCUMENTS

| | | | |
|---|---|---|---|
| 2,466,915 | 4/1949 | Shields | 15/344 X |
| 2,483,176 | 9/1949 | Bishop | 51/427 |
| 2,487,366 | 11/1949 | Penno | 51/410 X |
| 2,494,773 | 1/1950 | Mead | 51/427 |
| 2,628,456 | 2/1953 | Berg | 51/427 X |
| 2,723,498 | 11/1955 | Hastrup | 51/427 |
| 3,407,538 | 10/1968 | Codina | 51/410 |
| 3,448,544 | 6/1969 | Cardon | 51/410 |
| 3,599,375 | 8/1971 | Nunemaker | 51/427 X |
| 4,045,915 | 9/1977 | Gilbert | 51/427 |

*Primary Examiner*—Gary L. Smith
*Attorney, Agent, or Firm*—Beaman & Beaman

[57] ABSTRACT

Portable sand blast apparatus for cleaning a surface at a confined location wherein the apparatus attaches to a conventional sand blasting nozzle and includes a flexible filter shroud having an open end terminating in a resilient sealing ring. The shroud confines the sand blast particles and functions as a filter bag to permit the escape of air while the flexible surface seal prevents escape of the particles adjacent the surface being treated. A handle is mounted at the shroud open end, and a transparent window may be incorporated into the shroud for visibility purposes.

10 Claims, 4 Drawing Figures

PORTABLE CONFINED SURFACE SAND BLAST APPARATUS

BRIEF SUMMARY OF THE INVENTION

The invention pertains to portable sand blasting apparatus wherein the area being cleaned is closely confined and the apparatus is of a low cost portable nature.

Sand blasting is commonly used to clean surfaces of paint, scale, oxidation and the like, and while the cleaning by impact of sand or similar abrasive particles against a surface will effectively clean the surface such cleaning techniques are not readily suitable for many purposes due to the contamination of the air and environment adjacent the work site resulting from sand and small particles becoming airborne.

While sand blast apparatus has been proposed which is capable of confining the sand and removed particles such apparatus is too expensive or cumbersome for many applications, such as automobile body work, and examples of known confined sand blast apparatus is shown in U.S. Pat. Nos. 2,483,176; 2,494,773; 2,628,456; 2,723,498 and 4,045,915.

It is an object of the invention to provide a portable sand blast apparatus for treating confined surfaces wherein the apparatus is lightweight, economically producible and efficient in operation.

A further object of the invention is to provide portable hand held sand blast apparatus which is capable of confining sand blast particles adjacent the work location, and wherein such particles cannot readily escape from the confined space.

Yet another object of the invention is to provide portable sand blast apparatus which may be readily utilized with a conventional hand held sand blast nozzle, and wherein a flexible seal is utilized capable of readily conforming to a variety of surface configurations which are to be cleaned.

The invention is adapted to be placed upon the nozzle of a conventional pistol grip type sand blast dispenser, and includes a shroud formed of a closely woven material having an orifice defined therein receiving the sand blast gun nozzle. Preferably, the orifice is defined by an elastomeric grommet capable of frictionally engaging the gun nozzle.

The opposite portion of the shroud from the orifice is open, and a ring sealed with respect to the shroud open end supports an annular compressible foam seal capable of readily conforming to non-planar surface configurations, such as the contours of automobile bodies. A handle may be attached to the shroud ring, and a transparent window may be defined in the flexible shroud for visibility purposes.

The compressible seal may be tightly held against the surface to be cleaned, and the flexible nature of the shroud permits the discharge of the sand blast gun to be directed within the confines of the seal as desired. The air ejected from the gun escapes through the shroud material, while sand particles and particles of the surface being cleaned are confined within the shroud for periodic removal therefrom. As the apparatus requires no vacuum particle disposing equipment, and utilizes conventional sand blast ejecting apparatus its economical feasability will be readily appreciated.

BRIEF DESCRIPTION OF THE DRAWINGS

The aforementioned objects of the invention will be appreciated from the following description and accompanying drawings wherein.

DESCRIPTION OF THE PREFERRED EMBODIMENT

Figure 1:
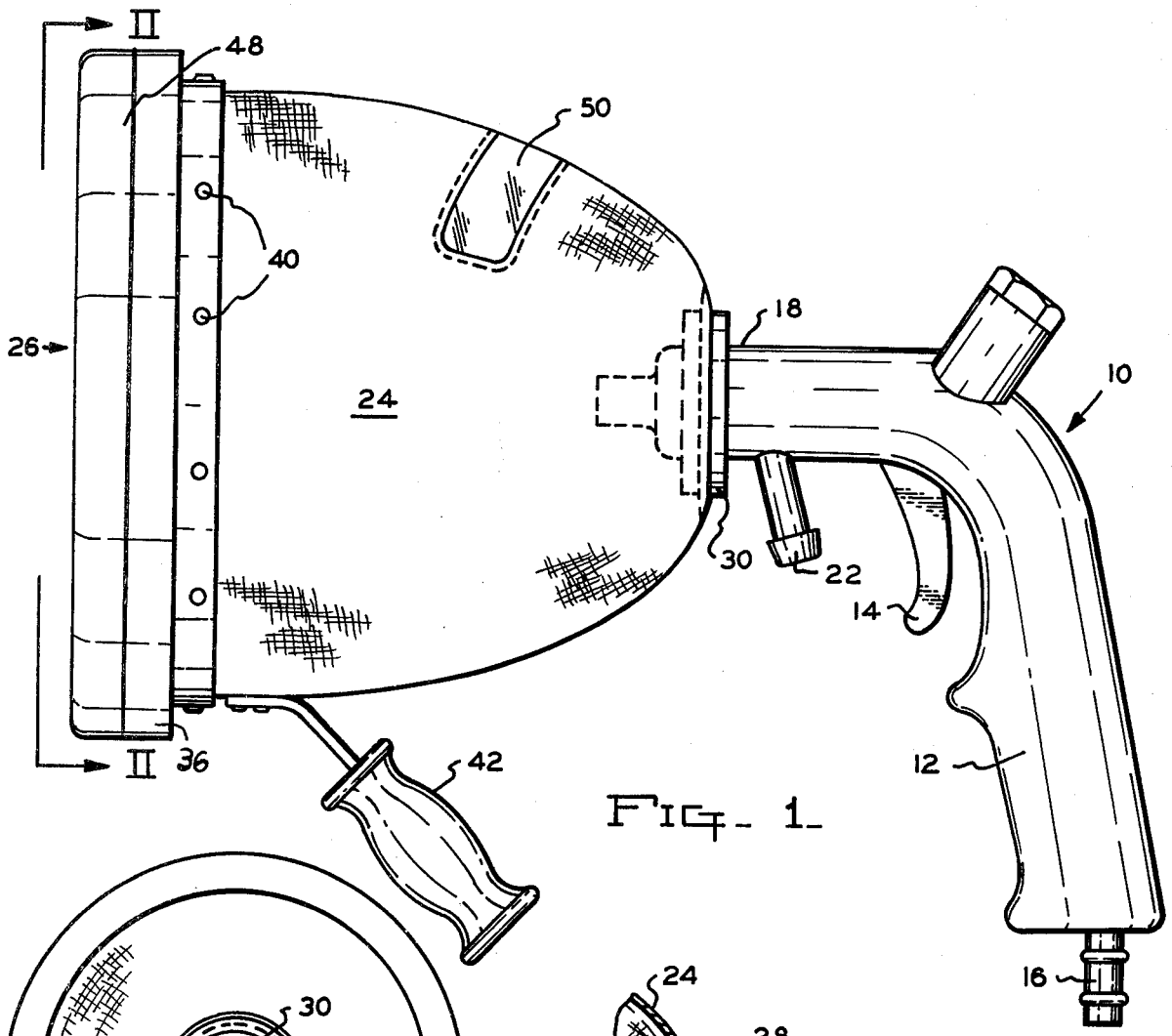
FIG. 1 is an elevational view of sand blast apparatus in accord with the invention.

The apparatus of the invention is adapted to be mounted upon a conventional sand blast dispenser, preferably of the pistol grip type, as represented at 10, and such apparatus commonly includes a handle 12 having a valve therein, not shown, actuated by a trigger 14 wherein actuation of the trigger permits air to flow through the gun as supplied through the air inlet 16 from a pressurized air source, and the air is ejected from the gun through the nozzle end 18 thereof which includes the outlet tube 20. The gun dispenser illustrated is typical, as available from ALC Company of Medina, Ohio, Model F. Abrasize cleaning materials, such as sand, powdered carbide, or other known sand blasting compositions, are fed into the air stream within the gun through supply tube 22 communicating with the cleaning material source as is known. Thus, as the air is ejected from the tube 20 the cleaning abrasive is contained therein for impingement upon the surface toward which the tube is directed.

The apparatus for confining the cleaning material includes a flexible shroud 24 having an open end 26, and an orifice 28 located in opposed relationship to the open end. Preferably, the shroud 24 is formed of a closely woven fabric having a weave pervious to air, but impervious to the sand particles, and the particles cleaned from the surface being treated. The orifice 28 is defined by an elastomeric grommet or washer 30 which includes a peripheral slot 32 receiving the fabric material, and the fabric material of the shroud may be bonded within the slot. The elastomer grommet includes a cylindrical bore 34 which is of a normal unextended diameter less than the diameter of the gun nozzle 18 wherein inserting the gun nozzle into the bore 34 expands the grommet to produce a firm frictional sealed engagement on the gun nozzle.

Figure 3:
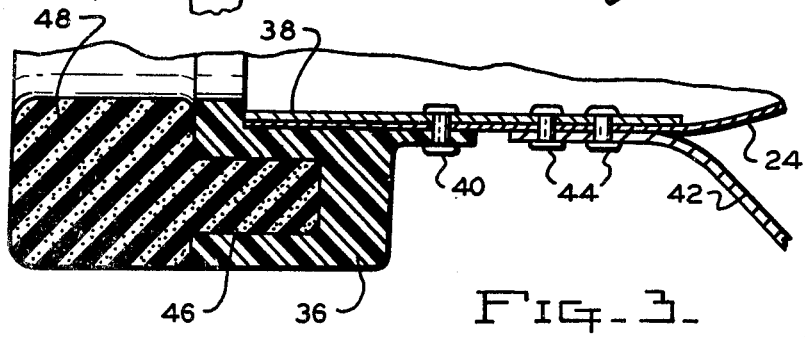
FIG. 3 is a detail, elevational, sectional, enlarged view of the shroud ring and seal.

The open end of the shroud 24 has an annular ring 36 formed of a synthetic plastic material connected thereto, and a metal reinforcing sleeve 38 is connected to the ring 36 by a plurality of rivets 40 to maintain the annular circular configuration of the ring, and also serve as a support for the handle 42 which is riveted to the sleeve at 44, FIG. 3. In this manner the ring 36 may be manually supported and positioned as desired.

The ring 36 includes an annular groove 46 which receives and supports the annular foam seal 48. The seal 48 is preferably formed of a soft resilient, open cell foam of the synthetic type which is flexible and compressible, and the seal may be bonded within the groove 46 by a suitable adhesive. It is desired that the axial dimension of the seal be sufficient to permit the seal to readily conform to the contour of automotive body configurations, such as fenders, hoods and the like, and to this end the axial dimension of the seal 48 will normally be at least three-quarters of an inch.

Figure 2:
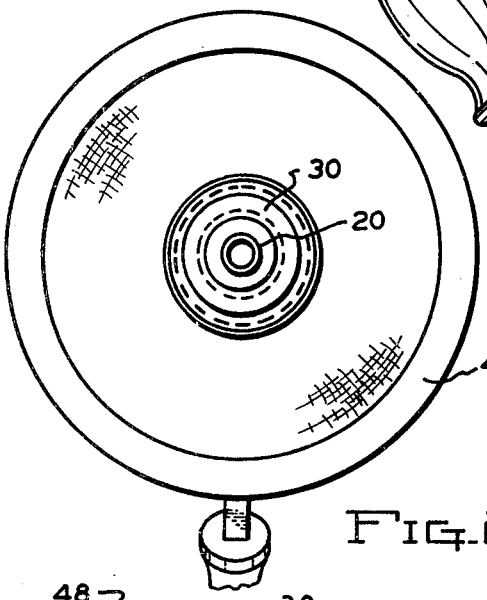
FIG. 2 is an elevational view of the apparatus open end as taken along Section II—II of FIG. 1.
Figure 4:
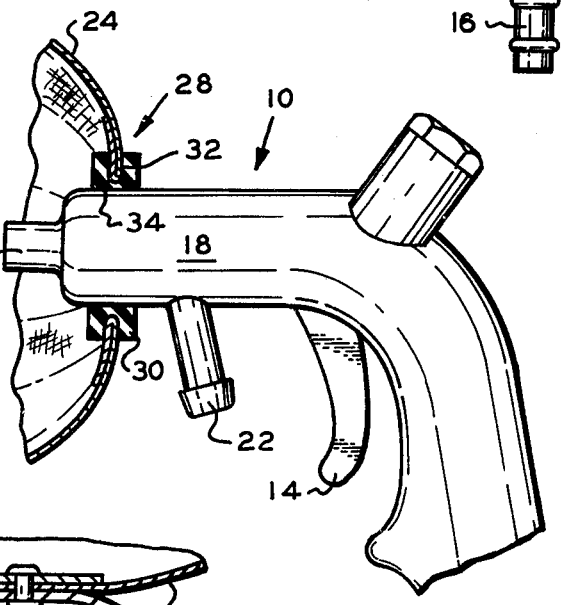
FIG. 4 is a detail, partially sectioned, elevational view of the sand blast gun and shroud orifice assembly.

In use, the elastomer grommet 30 is placed upon the nozzle 18 of the gun 10 as shown in FIGS. 1 and 2. Thereupon, the operator will grasp the handle 42 in one hand while holding the gun in the other, and by means of the handle firmly hold the seal 48 against the surface to be treated.

Once the seal is properly positioned and pressed against the surface to be treated sufficiently to produce a slight compression of the seal the trigger 14 depressed to introduce the air and abrasive blast into the shroud 24. The outlet tube 20 is pointed to the specific location to be cleaned within the confines of the seal 48, and the transparent window 50 formed of a clear plastic sewn into the shroud will permit the operator to observe the cleaning action. In practice, it has been found that the presence of a window is not necessary as the operator is able to direct the cleaning blast at the area to be cleaned without observation.

The sand blasting operation is quickly accomplished in view of the limited area to be cleaned, and the operator releases the trigger 14 prior to removing the seal 48 from the surface being treated. During the cleaning operation the air being injected into the shroud 24 has been escaping through the minute air passages defined in the shroud fabric, while the sand particles and the like have been filtered and retained within the shroud. After the air blast is terminated and the seal 48 removed from the treated surface the sand blast material and residue within the shroud may be dumped into an appropriate receptacle, and in many instances may be reused.

The diameter of the seal 48 will usually be less than 12 inches, and the apparatus of the invention is particularly suitable for cleaning rust, paint and oil from automobile bodies prior to repair thereof. The flexible nature of the shroud permits the gun to be easily aimed relative to the seal 48 and the entire area within the seal may be treated is desired. However, in normal use the area to be treated is quite small and the movement of the gun relative to the seal ring is limited. The apparatus in accord with the invention may be economically produced and may be readily used by garage mechanics without special skills or instruction.

It is appreciated that various modifications to the inventive concept may be apparent to those skilled in the art without departing from the scope of the invention.

I claim:

1. A portable sandblast apparatus for mounting upon a hand held sandblast nozzle comprising, in combination, a flexible shroud having an open end and a sandblast nozzle receiving orifice spaced from said open end, nozzle mounting means defined at said orifice for firmly and sealingly receiving a sandblast nozzle, air previous sand particle filter means defined in said shroud, and an annular flexible surface seal attached to said shroud open end for establishing a seal with the surface to be cleaned, the flexibility of said shroud permitting a nozzle within said mounting means to be freely moved for directional purposes while said seal is maintained in a sealed relationship with the surface to be cleaned.

2. In portable sandblast apparatus as in claim 1, said shroud comprising an air pervious flexible material having minute air passages defined therein whereby said shroud material air passages define said filter means.

3. In portable sandblast apparatus as in claim 2 wherein said shroud is formed of a closely woven fabric.

4. In portable sandblast apparatus as in claim 1, a resilient annular collar fixed to said shroud defining said orifice adapted to frictionally receive a sandblast nozzle and constituting said nozzle mounting means.

5. In portable sandblast apparatus as in claim 1, a transparent window defined in said shroud.

6. In portable sandblast apparatus as in claim 1, an annular seal support ring mounted upon said shroud open end in sealed relationship thereto, said flexible surface seal being mounted on said ring, and a handle attached to said ring.

7. In portable sandblast apparatus as in claim 6 wherein said surface seal is of a compressible foam material.

8. A portable hand held sandblast apparatus characterized by its ability to clean localized surface areas and confine sandblast particles comprising, in combination, a hand sandblast dispenser having a nozzle outlet, a flexible-closely woven fabric shroud having an open end and a nozzle receiving orifice spaced from said open end, said orifice being mounted on said nozzle outlet, said shroud being formed of an air pervious fabric constituting a sand particle filter, and an annular flexible surface seal attached to said shroud open end for establishing a seal with the surface to be cleaned.

9. In portable hand held sandblast apparatus as in claim 8, an annular seal support ring mounted upon said shroud open end in sealed relationship thereto, said flexible surface seal being mounted on said ring, and a handle attached to said ring.

10. In a portable hand held sandblast apparatus as in claim 8, a resilient annular collar fixed to said shroud defining said orifice adapted to frictionally receive said nozzle outlet.

* * * * *